United States Patent [19]

Sims

[11] Patent Number: 4,729,452

[45] Date of Patent: Mar. 8, 1988

[54] PRINTER SOUND ENCLOSURE

[75] Inventor: Louis Sims, Spokane, Wash.

[73] Assignee: Output Technology Corporation, Spokane, Wash.

[21] Appl. No.: 61,113

[22] Filed: Jun. 10, 1987

[51] Int. Cl.[4] ..... B41J 29/08

[52] U.S. Cl. ..... 181/201; 181/225

[58] Field of Search ..... 181/200–202, 181/225

[56] References Cited

U.S. PATENT DOCUMENTS 3,476,210 11/1969 Carlson ..... 181/201

4,215,762 8/1980 Cunningham et al. ..... 181/201

*Primary Examiner*—B. R. Fuller

*Attorney, Agent, or Firm*—Wells, St. John & Roberts

[57] ABSTRACT

A printer sound enclosure includes a perimeter wall defining a printer receiving compartment. A cover is positioned on the perimeter wall and is movable to permit access to the compartment for installing and operating a printer. An air duct is situated on the enclosure for open communication with an air vent on the printer housing. The air duct permits free passage of air for cooling purposes into or away from the printer housing. The air duct facilitates cooling of the printer components without requiring the use of an auxiliary fan on the enclosure. Sound reducing material is situated within the compartment and air duct to minimize sound emissions from the enclosure as the printer operates.

7 Claims, 6 Drawing Figures

PRINTER SOUND ENCLOSURE

TECHNICAL FIELD

The present invention relates to sound deadening enclosures for computer printers.

BACKGROUND OF THE INVENTION

The vast advantages of computer word processing technology are somewhat offset by the annoying hum and clatter of the computer printer devices. Computer keyboards are relatively quiet when in use so the noise from a printer, when activated, is especially annoying. Furthermore, printers operate at extremely high speeds so the sounds produced are quite distinctive from those of a manual or even electronic typewriter. The printing head in a computer printer operates at very high speed and consequently produces a fairly loud and continuous noise. It becomes desirable to minimize printer noise while maintaining proximity of the printer to the remainder of the computer equipment for easy access to the printout material produced.

As a solution to the printer noise problem, various sound reducing enclosures have been developed. These enclosures typically are in the form of a cover or box that receives the computer printer. The box will include appropriate sound deadening or sound absorbing materials lining the walls of the box and appropriate access doors and slots for permitting access to the printer and paperfeeds.

Prior sound deadening or dampening enclosures have been effective in reducing noise levels in the area around computer printers. However, the enclosures of themselves have not typically permitted adequate ventilation to the enclosed printers. The working components of computer printers become warm and can possibly overheat within a sound enclosure that does not permit relatively free circulation of cooling air. Auxiliary blowers have been introduced as a solution to this problem. A fan housing is attached to the sound enclosure and is used to either blow air into or out from the printer receiving compartment within the enclosure.

Blowers eliminate the cooling problem but do not improve the sound deadening qualities of the enclosures. The fans in fact create additional noise during operation. The fan blade and motor noise is not dampened from within the printer enclosures because the fans are typically mounted directly adjacent to the external surfaces of the enclosures.

Higher quality computer printers include internal fans for circulating air about heat producing components. These fans function effectively to circulate air from the ambient atmosphere about the computer components and are not overly noisy. Printer fans become substantially redundant when additional fans are used with the computer sound enclosure. Furthermore, the additional fan on a computer sound enclosure substantially increases the overall cost of the sound enclosure unit.

It may be understood from the above that it is desirable to obtain a form of computer sound enclosure with facilities for directing ambient, cooling air to the printer mechanisms without producing additional sound pollution.

BRIEF DESCRIPTION OF THE DRAWINGS

The preferred embodiment of the invention is illustrated in the accompanying drawings, in which.

DETAILED DESCRIPTION OF THE PREFERRED EMBODIMENT

Figure 1:
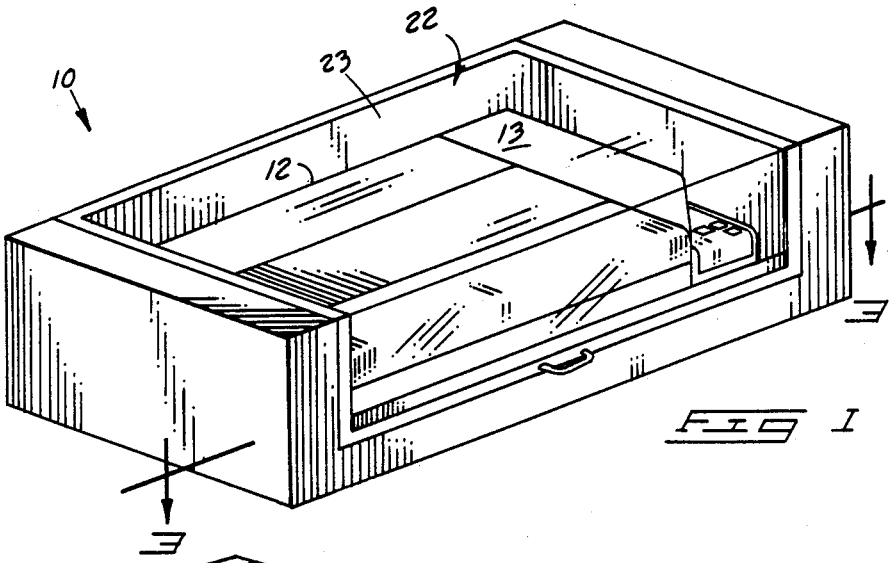
FIG. 1 is a pictorial view of the present enclosure with a computer printer mounted therein.

The following disclosure of the invention is submitted in compliance with the constitutional purpose of the Patent Laws "to promote the progress of science and useful arts" (Article 1, Section 8).

A preferred form of the present sound deadening enclosure is exemplified in the accompanying drawings and is designated therein by the reference numeral 10. The present enclosure 10 is provided for enclosing and reducing the level of noise in the vicinity of a computer printer 12.

Figure 2:
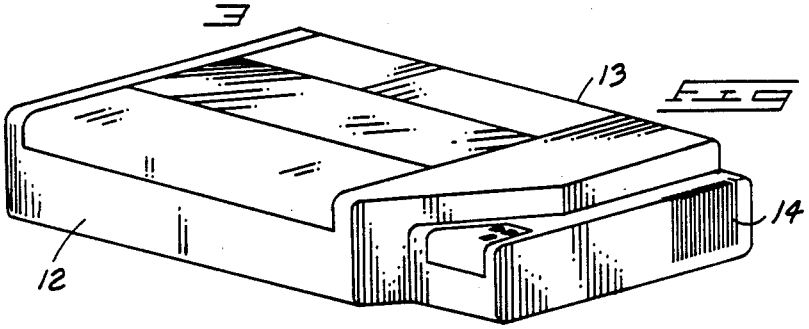
FIG. 2 is a pictorial view of a computer printer separate from the present sound enclosure.
Figure 3:
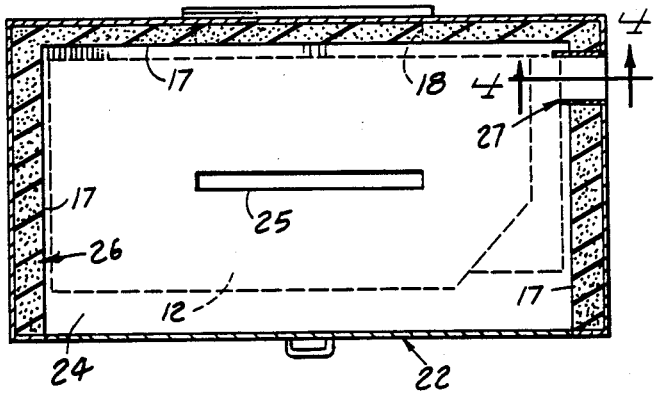
FIG. 3 is a sectional view through the enclosure, taken substantially along line 3—3 in FIG. 1 and showing the printer by dashed lines.
Figure 4:
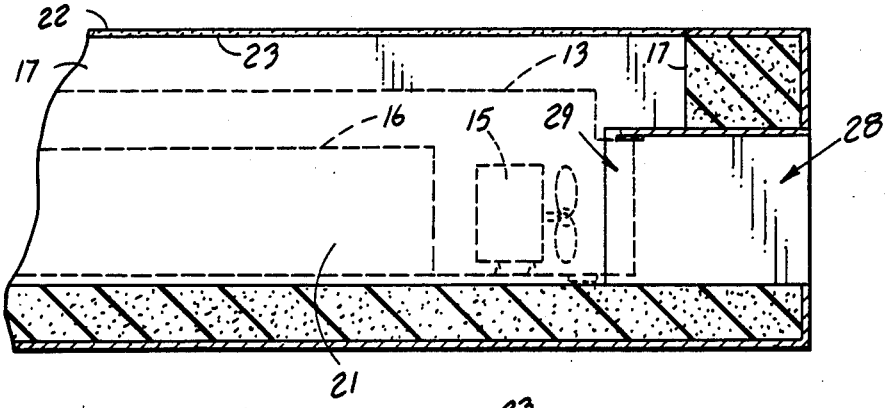
FIG. 4 is an enlarged fragmented sectional view of the air duct means in the present enclosure.
Figure 5:
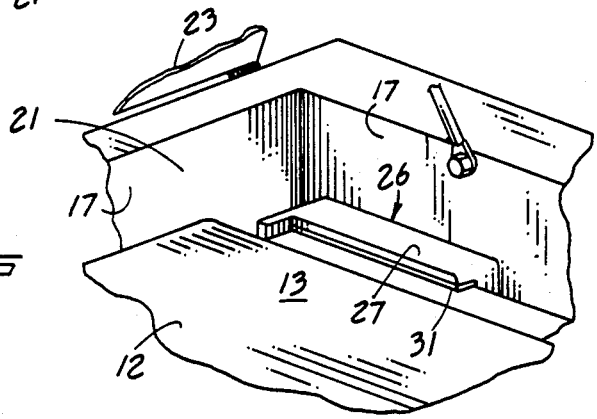
FIG. 5 is a fragmented pictorial view showing the relationship of the present air duct means and a computer printer.
Figure 6:
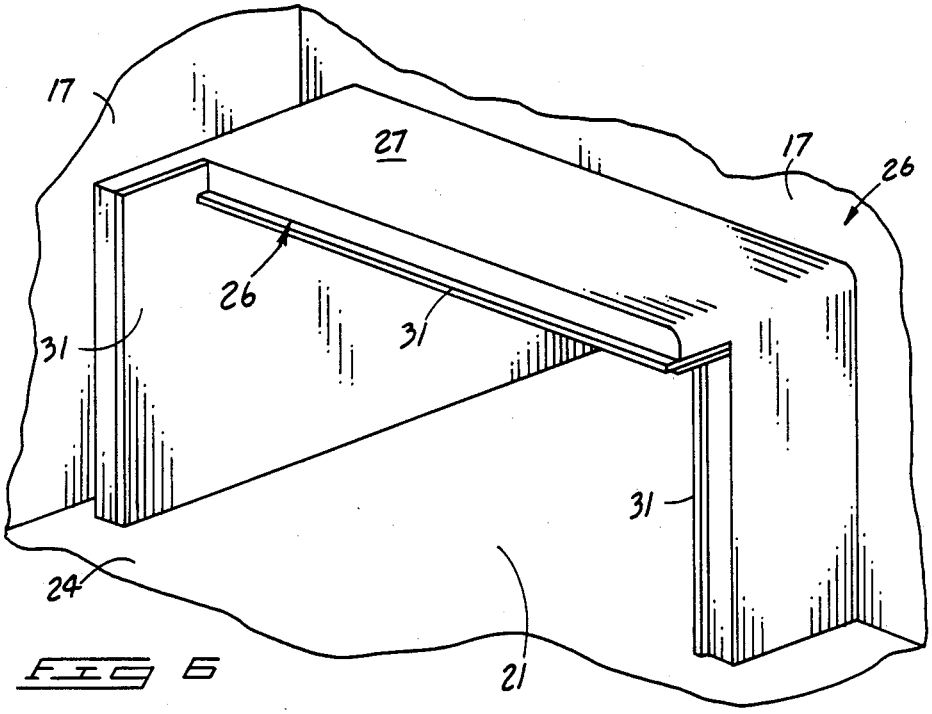
FIG. 6 is an enlarged, fragmentary pictorial view of the air duct means for the present enclosure.

One such printer 12 is generally illustrated in FIG. 2 of the drawings. The printer 12 generally includes an external housing 13 enclosing printer components 16 (shown dotted in FIG. 4) and an externally open cooling vent 14. A fan 15 (FIG. 4) may be provided within the printer housing. It is noted that such fans are typically found in higher quality printers but are not provided in all printers. Printers that are produced without cooling fans rely upon air convection currents for cooling purposes.

The cooling vent 14 is typically present regardless of the provision of an enclosed fan. Itis noted that the vent 14 is shown along an upright side wall of the printer housing 13. The vent opening may be situated in other locations in various other printer arrangements, depending upon printer housing design and location of the printing components within the housing.

The present enclosure 10 receives the computer printer 12, encloses it for sound reducing purposes, and permits ventilation of the internal printer components with minimal noise being transmitted to the air outside the enclosure. The structure disclosed in more detail below accomplishes this function.

The present sound enclosure 10 includes a substantially upright perimeter or peripheral wall member 17. The perimeter wall may be rigid and rectangular in configuration as shown in the drawings, or may be other configurations depending upon the external configuration of the printer to be received and aesthetic considerations.

The wall member 17 may include a substantially horizontal paper discharge slot 18. The discharge slot 18 is adapted to receive paper exiting from the computer printer 12.

Internal or inward facing surfaces of the wall member 17 define a compartment 21 that is shaped somewhat similarly to the external peripheral configuration of the printer 12. Space may be provided between opposed ends of the printer and adjacent sections of the wall member 17 to permit access to the printer for insertion and removal.

A cover member 22 is provided on the wall member 17 and is adapted to cover a computer printer 12 received within the compartment 21. The cover member 22 may be comprised of a hinged lid 23 that may be moved or pivoted clear of the computer printer in order to facilitate insertion or removal of the printer or to facilitate access to the printer controls.

At least part of the cover member 22 may be formed of a transparent material such as glass, "plexiglass" or a similar material that will facilitate visual access to a computer printer held within the compartment and that will function to dampen or otherwise assist in containing sound within the enclosure.

The enclosure may be provided with a floor member 24 for releasably supporting the printer. Floor member 24 may be attached to the wall member 17 adjacent lower edge surfaces thereof. The floor member may include a paper inlet slot 25 that facilitates feed of paper inwardly to the computer printer 12.

A sound reducing means 26 is provided on at least one of the members 17, 22, or 24. Preferably, the sound reducing means is provided both on the perimeter wall member 17 and on the floor member 24. It is also conceivable that sound reducing means, other than the material comprising the cover member 22, could be provided in addition to the cover member 22 to further decrease sound emissions from the enclosure. It has been found, however, that the sound dampening characteristics of the cover material, whether glass or plexiglass, is adequate when combined with the sound reducing materials placed along the internal surfaces of the wall member 17 and the floor member 24.

The sound reducing means may be any of a multitude of conventional sound absorption materials. Foamed porous plastic material, for example, may be effectively used along with appropriate surface treatment to maximize sound absorption or deadening capabilities. This material may be placed as indicated in the drawings about the internal surfaces of the wall member 17 and the upwardly facing surface of the floor member 24.

An important feature of the present invention is an air duct means 27 shown situated on the wall member 17 for the purpose of venting ambient external air to the vent opening 14 of the computer printer 12. The location of duct means 27 within the enclosure is dictated by the location of the printer vent 14. The present enclosure may therefore be produced with the duct means 27 situated at nearly any location about the enclosure 10 depending upon the specific location for the vent opening 14 in the associated computer printer 12. In the preferred example shown, the duct means 27 is formed through the wall member 17 in order to communicate directly with the vent opening 14 of the exemplified computer printer 12.

For example, a particular brand of printer may include a cooling air vent along a back side wall instead of the end side wall shown in FIG. 2. In this instance, the sound enclosure would be produced with the air duct means extending through an appropriate backside wall and be positioned thereon for communication with the back wall vent of the particular computer printer.

The air duct means 27 includes an outward open end 28 that communicates openly with the ambient atmosphere outside the enclosure 10. The duct means projects into the compartment 21 to an inward open end 29 that is adapted to be positioned directly adjacent to the vent opening 14 of a printer 12 placed within the compartment 21. It is preferred that the inner open end 29 be situated to directly abut the printer housing 13 about the vent opening 14.

The inward open end 29 of air duct means 27 may be provided with a resilient seal means 31. Resilient seal means 31 is utilized to directly abut the computer printer housing 13 about the vent opening 14. The resilient seal means 31 is resilient in order to absorb any noise producing vibration at the contact surface between the air duct and printer housing. The seal may be formed of a resilient sound dampening material utilized within the wall surfaces of the duct.

The sound reducing means 26 may be situated within the air duct means 27. Here, means 26 may be provided in the form of a layer of porous sound dampening material (such as neoprene) that will not obstruct free passage of air but will at least dampen sounds emitted through the duct means 27.

It is important to note that the air duct means 27 is open along its length. There is no fan present. Air passage is controlled by the cooling system provided within the printer itself. Thus, if an air discharge fan is provided within the printer housing, discharge air will be directed outward through the air duct means 27 to the ambient atmosphere. Intake air would then be drawn into the printer through the appropriate paper inlet and discharge slots (25, 18) provided in the enclosure wall and floor members. Conversely, if the printer fan is provided to draw cooling air into the computer housing, the air duct means will function to permit free passage of ambient air from outside the enclosure to the internal components of the printer. In this instance, air discharged from the computer housing would be free to exit through the paper inlet 25 and discharge opening 18.

Operation of the present invention begins following placement of a printer within the present enclosure. The cover 22 is opened and the printer 12 is placed within the enclosure in such a position that the seal means 31 at the open inward end 29 of the air duct means 27 is pressed against the housing 13 about the housing air vent opening 14. The present enclosure is now operational. Once the printer is activated, the cover member 22 may be closed while the printer operates. Sound from the printer will be substantially contained within the enclosure through the sound reducing means 26 about the internal surfaces of the enclosure, while the internal mechanisms of the printer are cooled as they would normally be when the printer is used outside of the enclosure. Any fan mechanisms or convection cooling systems within the computer printer housing are allowed to function normally through the present air duct means.

It is again pointed out that there are no auxiliary fans required with this arrangement since air is permitted to freely move between the ambient atmosphere and the cooling system for the computer printer. The present sound enclosure can therefore be produced without the additional expense of a cooling fan and without the additional noise such fans produce.

It is further pointed out that the present air duct means 27 need not be connected to a specific air intake or air discharge. It may be connected to either. If means 27 is utilized as an air discharge duct, intake air may be received through other openings within the enclosure such as the paper inlet and discharge openings. The reverse would be true of the air duct means 27 when utilized for air intake (the paper inlet and discharge openings would then be used as air discharge ducts).

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

What is claimed is:

1. A sound enclosure for a printer having a printer housing with a vent opening formed therein for cooling printer mechanisms within the housing, the sound enclosure comprising:

an upright perimeter wall member defining a compartment adapted to encircle the printer;

a cover member on the perimeter wall member adapted to cover the printer within the compartment;

sound reducing means on at least one of the members for absorbing sound from the printer held within the compartment; and air duct means connected to one of the members and having an open outward end opening outwardly of the enclosure and an open inward end adapted to abut the printer housing about the vent opening for venting the printer to ambient atmosphere outside the sound enclosure.

2. The sound enclosure of claim 1 further comprising a floor member on the perimeter wall member opposite the cover member and wherein the sound reducing means is provided on the floor member.

3. The sound enclosure of claim 1 wherein the air duct means includes resilient seal means at the open inward end thereof for releasable engagement against the printer within the compartment.

4. The sound deadening enclosure of claim 1 further comprising a sound absorbing material liner within the air duct.

5. A sound enclosure for a printer having a printer housing with a vent opening formed therein for cooling printer mechanisms within the housing, the sound enclosure enclosing:

a substantially horizontal floor member for receiving and supporting the printer;

an upright wall member having a bottom edge joined to and extending about the floor member to form a compartment for receiving the printer therein;

a cover means for selectively closing the compartment and for permitting selection access to the printer held within the compartment;

sound reducing means on the floor member and the peripheral wall for confining sounds produced by the printer held within the compartment to the area within the compartment; and duct means having an outer opening communicating with the ambient atmosphere outside the sound enclosure, and an inward opening adapted to be positioned adjacent the vent opening of the printer held within the compartment, for ventilating the printer.

6. The sound enclosure of claim 5 wherein the duct means includes a resilient seal means for releasable engagement with the printer housing about the vent opening formed therein.

7. The sound enclosure of claim 5 further comprising a sound absorbing liner within the air duct.

* * * * *